United States Patent [19]

Ward

[11] 4,287,934

[45] Sep. 8, 1981

[54] CONTINUOUS CASTING MOLD

[75] Inventor: George C. Ward, Carrollton, Ga.

[73] Assignee: Southwire Company, Carrollton, Ga.

[21] Appl. No.: 162,237

[22] Filed: Jun. 23, 1980

Related U.S. Application Data

[63] Continuation-in-part of Ser. No. 860,648, Dec. 14, 1977, Pat. No. 4,211,271.

[51] Int. Cl.[3] ..... B22D 11/06

[52] U.S. Cl. ..... 164/482; 164/433

[58] Field of Search ..... 164/87, 88, 433, 434, 164/122, 123, 429, 432

[56] References Cited

U.S. PATENT DOCUMENTS 4,211,271 7/1980 Ward ..... 164/433 X

*Primary Examiner*—Robert D. Baldwin
*Assistant Examiner*—K. Y. Lin
*Attorney, Agent, or Firm*—Herbert M. Hanegan; Stanley L. Tate; Robert S. Linne

[57] ABSTRACT

An improvement in wheel-band type continuous metal casting machines wherein a stationary corner filling device is used in combination with the usual moving mold members, such as the wheel and band, to modify the mold geometry so as to prevent corner cracking of the cast bar due to the uneven solidification stresses present in conventionally molded shapes having sharp or square edges, especially useful in modifying the usual trapezoidal cross sections of prior art molds for the casting of steel alloys.

5 Claims, 3 Drawing Figures

CONTINUOUS CASTING MOLD

CROSS REFERENCE TO RELATED APPLICATIONS

This application is a continuation-in-part of my copending application filed on Dec. 14, 1977, Ser. No. 860,648, now U.S. Pat. No. 4,211,271.

BACKGROUND OF THE INVENTION

This invention relates to the continuous molten metal casting arts, and more particularly to wheel-band casting machines wherein the mold geometry is substantially square, rectangular, or trapezoidal. Certain embodiments of this invention may also be used with conventional twin belt or/and plate molds or other vertical casting machines which normally have a mold cavity containing sharp corners and thus form a cast bar having sharp edges.

It is well known in the prior art that combination of the following factors are closely interrelated to the presence or absence of bar cracks, especially corner cracks, in cast steel bar produced by typical metal casting machines: the composition of the metal or alloy being cast, especially alloys in which precipitation of some constituents is a problem; mold geometry and dimensions; speed of casting; overall cooling rate and uniformity of bar cooling. Of these factors, only the metal composition being cast is fixed by preference; except that the mold geometry cannot usually be changed during the casting operation but only when the operation is shut down, and then only with extreme difficulty. Many other parameters are variable within certain limits. With conventional wheel-band casting machines the trapezoidal shaped mold cross section with rounded bottom corners has long been recognized as the optimum shape for maximum wheel life, promotion of the desirable transverse solidification pattern, and ease of bar extraction from the mold (see for example U.S. Pat. No. 3,818,972 and 3,834,444 by Milton Berry and assigned to the assignee of the present invention). However, cast bars having trapezoidal or square cross sections undergoing even slight bending while hot may tend to produce longitudinal or transverse bar cracks with certain metal alloys such as steel, even when the cooling rates, or other combinations of parameters are varied over their permissable ranges.

These cracks are attributed to the difficulty of obtaining certain combinations of the above variable casting characteristics, especially heat transfer, casting rate, and alloy constituents, with a fixed mold geometry. It is known from the prior art that some factors are more important than others. For example, when certain constituent elements are precipitated to the grain boundaries, they then solidify at a cooler temperature than the predominant constituents. Due to the heat transfer characteristics of conventional square or trapezoidal molds, the intermetallic boundary in a cast bar forms along a longitudinal line generally extending from the corners toward the center, especially the sharp top corners of bars cast in the trapezoidal molds, thereby increasing the risk of bar cracking at this point. Various references in the prior art suggest changing the alloy composition to change the precipitation patterns or changing other factors such as cooling or casting rates to avoid such cracking. This invention is directed at alternate means to reduce or eliminate cracking, thus avoiding the complexities of chemical adjustment and eliminating the uncertainity of changing cooling characteristics for each of several alloys. It also permits continuous casting of otherwise difficult alloy combinations.

Further, in most prior art processes, mechanical corner preparation, such as scalping, is required to facilitate optimum rolling of the cast bar stock into rod, even if all parameters have been adjusted to minimize corner cracking, due to other common corner defects such as excessive porosity or excess flash or fins (i.e., material which has leaked between the wheel and band and solidified to form a thin metal fin) as illustrated in U.S. Pat. Nos. 3,780,552 and 3,469,620.

U.S. Pat. No. 3,520,352 discloses the use of insulating blocks or the like afixed external to the mold corners of plate molds used for vertical casting. However, in the use disclosed in that patent, the blocks are used solely to prevent expressive solidification stresses, and thus cracking, in the cast metal near joints of the plate mold which arise due to differential thermal contraction or expansion of the solidifying cast bar. Molten metal spills and breakthroughs can occur in such a casting method if no such precautions are taken to prevent corner cracking. The instant invention, however, is directed to an entirely different use for the introduction of a supplemental shaping material into the mold cavity itself.

SUMMARY OF THE INVENTION

In this invention, it has been found that reducing or modifying the heat transfer rate during solidification in the wheel-band corners greatly reduces the tendency of both transverse and longitudinal bar cracks. The combination of said heat transfer modification and other geometric factors such as well radiused mold corners, improves elimination of such cracks.

Briefly described, the embodiments of the present invention comprise the introduction of a fixed molding member or shaping device into the generally trapezoidal mold cavity near the junction of the wheel and band in a continuous steel casting machine of the wheel-band type wherein longitudinal or transverse corner cracking due to the sharp corners and/or solidification pattern due to heat extraction is upset sufficiently to permit more desirable transverse solidification, thereby reducing or eliminating said corner cracking.

The cooling rate of the metal can be influenced or controlled by modifying the physical or thermal characteristics of the device. Where the device is copper or the like it may be additionally treated with a release agent such as a metal or chemical wash, thereby providing a more suitable molding film to eliminate any potential problem with sticking of the just solidifying cast bar.

More specifically, a supplemental device is purposely introduced into the casting machine at the top of the mold to sufficiently modify the cross section of the mold cavities such that a corner chamber or radius or its equivalent is formed and the heat extraction rate is modified to alter the transverse solidification pattern in the resulting cast bar.

Thus it is an object of this invention to provide a method by which transverse and longitudinal bar corner cracking, often occurring in continuous cast steel bars due to an improper solidification pattern, may be reduced or eliminated.

Another object of this invention is the retardation of heat transfer from the solidifying cast bar to the mold only at sharp corners.

Another object of the invention is to allow the production of a wider range of compositions of metal bars with only a small variation in operating factors by providing means to vary the mold shape.

Still another object of this invention is the provision of a method and apparatus to reduce longitudinal and transverse bar corner cracking which may be used with prior art wheel-band, twin belt, plate mold, or other casting machines.

Other objects, features, and advantages of the present invention will become apparent to those skilled in the art upon reading the following specification when read in conjunction with the accompanying drawings and appended claims.

BRIEF DESCRIPTION OF THE DRAWINGS

The invention will now be explained in more detail with respect to the accompanying drawings in which.

DESCRIPTION OF THE PREFERRED EMBODIMENT

Figure 1:
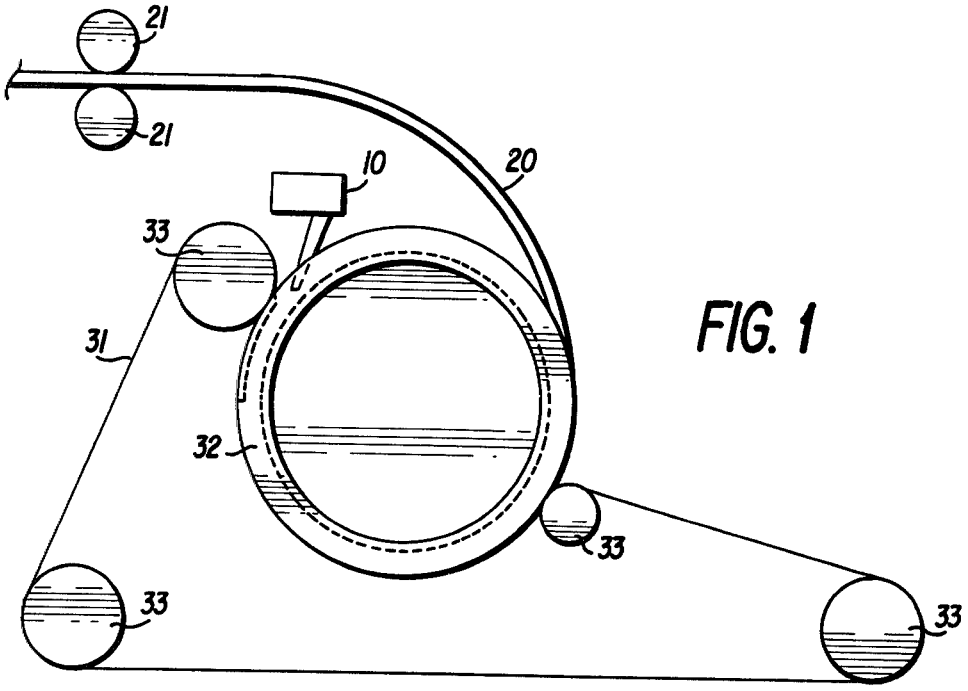
FIG. 1 is a schematic diagram illustrating one example of apparatus suitable to practice the invention, this apparatus comprises a casting machine having a rotatable casting wheel containing a peripheral groove and an endless metallic band which seals a length of the groove forming a mold to receive molten metal.

Referring now to the drawing, in which like numerals refer to like parts throughout the several views, FIG. 1 schematically depicts wheel-belt casting machine suitable for practicing the method of the present invention. The continuous casting machine comprises a rotatable casting wheel (32) having a peripheral groove therein, a flexible metal band (31) guided by a plurality of guide wheels (33) which bias the flexible band (31) against the casting wheel (32) for a portion of the circumference of the wheel so as to cover the peripheral groove and thereby form a mold between the band (31) and the casting wheel (32).

As molten metal is poured into the mold through tundish (10), the casting wheel (32) is rotated and the band (31) moves with the casting wheel to form a moving mold. A cooling system (not shown) within the casting machine cause the molten metal to solidify in the mold which then exits the casting wheel (32) as a substantially solid cast bar (20).

The cast bar (20) may be assisted along its arcuate path by motor driver pinch rolls (21) and other guide rollers, not shown, all of which are well known in the art.

Figure 2:
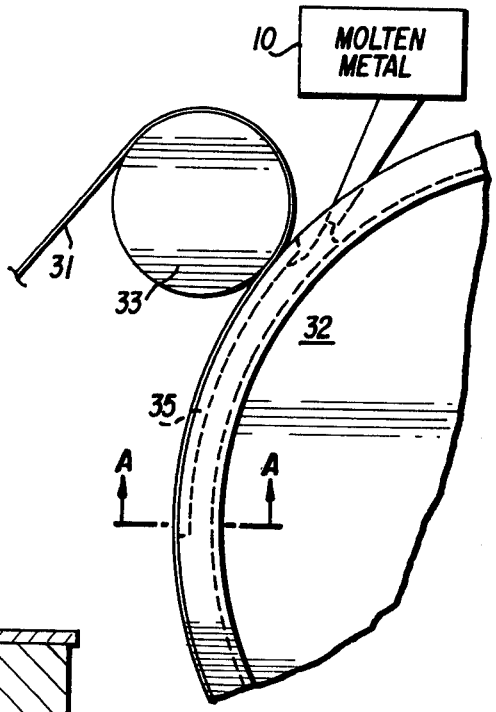
FIG. 2 shows an enlarged view of the portion of the casting machine containing the device of the present invention.

FIG. 2 shows an enlarged view of the casting machine in the area where the molten metal enters the mold and begins to solidify. The supplemental molding device (35) of the present invention is inserted into the corners of the mold near the junction of the wheel (32) and the band (31). Preferably the device is cooled by circulating water supplied by the casting machine cooling system, not shown, but sufficient cooling may be provided by passive heat transfer through the wheel and band when casting at a low rate or when casting low temperature metals.

The shaping device must extend into the mold for a distance calculated by considering the ferrostatic pressure of the molten metal and the thickness or strength of the partially solidified skin on the cast bar. This distance varies somewhat with the system's operating parameters but may be easily determined in practice. As the bar starts to solidify adjacent the shaping device, it advances with the mold and thus slides along the surface of the device until it is no longer supported by the device. At this point the skin may bulge somewhat due to ferrostatic pressure but it should not rupture. Thus the cast bar will not have such a sharp corner that it fills the remaining length of the mold cavity. The air gap so created will reduce the cooling rate of the corners so as to aid in the prevention of stress cracks.

Figure 3:
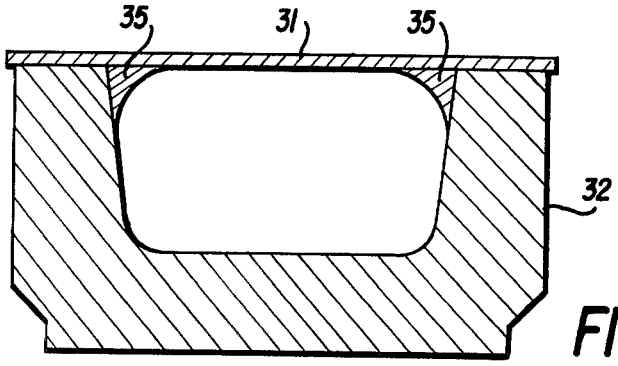
FIG. 3 shows a cross sectional view of the mold along the lines A—A of FIG. 2.

FIG. 3 illustrates the cross-sectional shape of the mold along lines A—A of FIG. 2 and shows the supplemental molding devise (35) of the present invention. The mold has a width W, a depth D and corners which are generally of rounded shape and have a nominal radius of curvature R. Continuous cast bar (20) is produced in a wheel-band type casting mold which includes the device for shaping the sharp corners of a cast bar at least during solidification. The means for shaping the corners of the cast bar can be triangular or curved to form a champfered or rounded edge on the bar.

FIG. 3 illustrates a curved sealing means (35) introduced between the casting wheel (32) and the band (31). The shaping device may be somewhat thermally insulating or conducting. In either case, it will affect the solidification pattern of the cast bar by changing the direction of heat transfer and therefore the location of the grain boundary lines. Also due to the shaped corners, the stresses set up in the cast bar as it solidifies will be much less severe.

In all the embodiments it is desirable that the corner shaping means is such that the resulting cast bar has a rounded or otherwise shaped edge where the approximate radius of curvature of the edge is at least about ten percent of the shorter side of the cast bar. For example, if the mold is two inches deep and three inches wide, then the edges should have a nominal radius of curvature of at least about 0.20 inches so that the solidification stresses will not cause corner cracking.

While the invention has been illustrated and described as embodied in an arrangement for a wheel-belt casting machine it is not intended to be limited to the details shown, since various modifications and structural changes may be made without departing in any way from the spirit and scope of the present invention.

Without further analysis, it is believed that the foregoing will fully reveal the essence of the present invention so that others can, by applying current knowledge or reasonable experimentation, readily adapt it for various applications without omitting features that, from the standpoint of prior art, fairly constitute essential characteristics of the generic or specific aspects of this invention and, therefore, such adaptations should and are intended to be comprehended within the meaning and scope of equivalence of the following claims.

What is claimed is:

1. An improved process for the continuous casting of metal of the type wherein molten metal is cast into a continuously advancing molding cavity formed by at least one endless moving band in conjunction with other mold surfaces so as to form a molding cavity having at least one sharp corner at the junction of said band and said other mold surfaces, and wherein the molten metal is solidified in the shape of said molding cavity to form a cast bar which is then extracted for further processing, wherein the improvement comprises the steps of:

introducing a fixed shaping means for eliminating the sharp corner into said advancing molding cavity near said junction; casting molten metal into the cavity and adjacent said shaping means; advancing the cavity without advancing the shaping means; cooling the molten metal to form a solid shell adjacent the mold surfaces while forming a non-sharp edge on the solidifying cast bar; advancing the cast bar with the cavity while sliding the cast bar along the shaping means and extracting the cast bar from the mold for further processing.

2. The process of claim 1 wherein said molten metal is steel and said fixed shaping means is used to decrease the heat transfer rate from the portion of the cast bar near said junction thereby reducing the solidification stress therein which cooperates with the nonsharp edge to substantially eliminate corner cracking of the cast steel bar.

3. An improved process for the continuous casting of metals of the type wherein molten metal is cast into a moving mold formed by a peripheral groove in a rotating casting wheel and a band which seals a length of said groove, and wherein the molten metal is solidified in the shape of said mold to form a cast bar which is subsequently extracted from the mold for further processing, wherein the improvement comprises the step of modifying the cross-sectional shape of said mold by introducing into said moving mold a nonmoving mold defining means for eliminating the sharp corners of the mold which would otherwise occur at the junction of the wheel groove and the band; and wherein said step of modifying the shape of the mold comprises providing a barrier between the molten metal and said wheel and band junction at least until a solid skin forms on the solidifiying metal and forming a nonsharp edge on the resulting solid cast bar which has a nominal radius of at least ten percent of the mold depth.

4. The process of claim 3 wherein said step of modifying the mold comprises introducing a solid triangularly-shaped device into the mold near the junction of the wheel and the band prior to casting the molten metal, advancing the mold while holding the device fixed then casting said molten metal into the mold containing said device and cooling the molten metal to form a solid cast bar having a rounded edge, said rounded edge being generated by the presence of said device.

5. Improved apparatus for the continuous casting of metals of the type having a continuously advancing molding cavity formed by an endless moving band in cooperation with a peripheral groove in a rotating casting wheel which is adapted to receive molten metal and solidifying said metal in the shape of said cavity to form a continuous length of cast bar, wherein the improvement comprises:

an additional mold defining means for eliminating the sharp corner of the molding cavity which would otherwise occur at the junction of said band and said wheel, said means extending into the molding cavity without advancing as the casting wheel rotates and adapted to provide a barrier between cast molten metal and said junction.

* * * * *